US006814488B2

(12) United States Patent
Thandiackal et al.

(10) Patent No.: US 6,814,488 B2
(45) Date of Patent: Nov. 9, 2004

(54) OIL EXPANSION COMPENSATION METHOD FOR INTEGRATED X-RAY GENERATOR

(75) Inventors: Lijo Joseph Thandiackal, Bangalore (IN); Denis Perrillat, Paris (FR)

(73) Assignee: GE Medical Systems Global Technology Company, LLC, Waukesha, WI (US)

( * ) Notice: Subject to any disclaimer, the term of this patent is extended or adjusted under 35 U.S.C. 154(b) by 15 days.

(21) Appl. No.: 10/304,237

(22) Filed: Nov. 26, 2002

(65) Prior Publication Data

US 2003/0099326 A1 May 29, 2003

(30) Foreign Application Priority Data

Nov. 27, 2001 (JP) ..... 2001-360280

(51) Int. Cl.[7] ..... H05G 1/06
(52) U.S. Cl. ..... 378/194; 378/193; 378/200
(58) Field of Search ..... 378/101, 102, 378/103, 119, 121, 193, 194, 199, 200; 174/15.1, 15.5, 15.6

(56) References Cited

U.S. PATENT DOCUMENTS

| | | | |
|---|---|---|---|
| 1,941,270 | A | 12/1933 | Pieper |
| 2,036,096 | A | 3/1936 | Pieper |
| 2,194,369 | A | 3/1940 | Simon |
| 2,320,559 | A | 6/1943 | Bouwers |
| 2,592,496 | A | 4/1952 | Vigh |
| 4,546,489 | A | 10/1985 | Kuhnke et al. |
| 5,067,146 | A | 11/1991 | Meinel et al. |
| 5,083,307 | A | 1/1992 | Meinel et al. |

*Primary Examiner*—Edward J. Glick
*Assistant Examiner*—Allen C. Ho
(74) *Attorney, Agent, or Firm*—Carl B. Horton, Esq.; Armstrong Teasdale LLP

(57) ABSTRACT

An object of the present invention is to provide an X-ray generator capable of compensating for the volume expansion of an insulating oil without the necessity of labor-intensive maintenance. A tubular body is included to penetrate through a tank that is sealed while accommodating a high-voltage assembly and an X-ray tube assembly and having an insulating oil poured thereinto. The lumen of the tubular body opens onto the ambient space at both ends of the tubular body. The tubular body expands or contracts depending on a difference between the pressure in the lumen and the internal pressure of the tank.

8 Claims, 12 Drawing Sheets

FIG. 10

| PHYSICAL PROPERTY | VALUE | DESCRIPTION |
|---|---|---|
| DENSITY, g/cc | 1.15 | LOWER LIMIT, SYNTHETIC MATERIAL |
| SHORE HARDNESS | 75 | VERY WIDE RANGE OF HARDNESS LEVELS IS ACCEPTABLE, DEPENDENT ON WHAT ELEMENTS OR COMPOUNDS ARE SYNTHESIZED |
| TENSILE STRENGTH, MAXIMUM, MPa | 21 | SYNTHETIC TIRE |
| EXPANSION RATIO %; ELONGATION AFTER FRACTURE | 320 | 20 cm/min |
| MODULUS OF ELASTICITY, GPa | 0.003 | 100% |
| COMPRESSIBILITY, % | 5 | |
| MAXIMUM OPERATIONAL TEMPERATURE, AIR, °C | 120 | |
| MINIMUM OPERATIONAL TEMPERATURE, AIR, °C | -30 | |

OIL EXPANSION COMPENSATION METHOD FOR INTEGRATED X-RAY GENERATOR

CROSS REFERENCE TO RELATED APPLICATIONS

This application claims the benefit of Japanese Application No. 2001-360280 filed Nov. 27, 2001.

BACKGROUND OF THE INVENTION

The present invention relates to an X-ray generator, or more particularly, to an X-ray generator having a tank, which accommodates a high-voltage assembly and an X-ray tube, has an insulating fluid poured thereinto, and is sealed. In the X-ray generator, the volume expansion of the insulating fluid can be compensated for without the necessity of labor-intensive maintenance.

In an X-ray generator having a tank, which accommodates a high-voltage assembly and an X-ray tube assembly, has an insulating fluid poured thereinto, and is sealed, the volume expansion of the insulating fluid is derived from heat dissipation caused by the high-voltage assembly and X-ray tube assembly. This causes the internal pressure of the tank to rise.

In efforts to prevent the rise in the internal pressure of the tank, conventional X-ray generators have a hole bored in the top of the tank. A sack member of a rubber sack is put into the tank through the hole, and the lip of the opening of the sack is attached to the tank wall around the hole in order to keep the tank watertight.

The sack expands or contracts depending on a difference between the luminal pressure of the sack member and the internal pressure of the tank, whereby the luminal pressure of the sack and the internal pressure of the tank become substantially equal to each other. However, the lumen of the sack member communicates with the ambient space at the opening. Therefore, the internal pressure of the tank remains substantially equal to the pressure in the ambient space irrespective of the volume expansion of the insulating fluid.

As mentioned above, the conventional X-ray generators use the rubber sack to compensate for the volume expansion of the insulating fluid.

However, dust floating in the ambient space is likely to accumulate in the lumen of the sack member of the sack. This necessitates periodical cleaning, or anyhow, poses a problem in that labor-intensive maintenance is required.

Moreover, in the conventional X-ray generators, when electric circuit cards are mounted with the tank between them, a cable linking the electric circuit cards is routed outside the tank and becomes an obstacle.

SUMMARY OF THE INVENTION

Therefore, an object of the present invention is to provide an X-ray generator capable of compensating for the volume expansion of an insulating fluid without labor-intensive maintenance. Moreover, a cable linking electric circuit cards mounted with a tank between them can be routed so that it will not be an obstacle.

According to the first aspect of the present invention, there is provided an X-ray generator having a tank, which accommodates a high-voltage assembly and an X-ray tube assembly, has an insulating fluid poured into, and is sealed. A tubular body is included to penetrate through the tank. The lumen of the tubular body opens onto the ambient space at both ends of the tubular body. The tubular body expands or contracts depending on a difference between the luminal pressure thereof and the internal pressure of the tank.

In the X-ray generator in which the first aspect is implemented, the tubular body expands or contracts depending on the difference between the luminal pressure thereof and the internal pressure of the tank. Since the lumen of the tubular body opens onto the ambient space, the internal pressure of the tank remains substantially equal to the pressure in the ambient space. Consequently, the volume expansion of the insulating fluid can be compensated for. Since the lumen of the tubular body opens onto the ambient space at both ends of the tubular body, dust floating in the ambient space hardly accumulates in the lumen of the tubular body. This obviates labor-intensive maintenance. Furthermore, the tubular body penetrates through the tank. Therefore, when the cable linking the electric circuit cards mounted with the tank between them passes through the lumen of the tubular body, it is unnecessary to route the cable outside the tank. In other words, the cable linking the electric circuit cards with the tank between them can be routed so that it will not be an obstacle.

According to the second aspect of the present invention, an X-ray generator having the same components as the foregoing ones is characterized in that the tubular body is made of an oil-proof rubber material.

In the X-ray generator in which the second aspect is implemented, the tubular body is made of an oil-proof material. When an insulating oil is adopted as the insulating fluid, deterioration of the tubular body can be prevented. Moreover, since the tubular body is made of a rubber material, the tubular body can readily expand or contract responsively to a pressure.

According to the third aspect of the present invention, an X-ray generator having the same components as the aforesaid ones is characterized in that the oil-proof rubber material is a nitrile rubber.

In the X-ray generator in which the third aspect is implemented therein, a nitrile rubber (NBR) is adopted as the oil-proof rubber material. Consequently, the tubular body can be manufactured at low cost.

According to the fourth aspect of the present invention, an X-ray generator having the same components as the aforesaid ones is characterized in that the tubular body penetrates through the tank in a direction of X-irradiation.

In the X-ray generator in which the fourth aspect is implemented, the tubular body penetrates through the tank in the direction of X-irradiation. The direction of X-irradiation is often a vertical direction close to a horizontal direction. Even if dust floating in the ambient space enters the lumen of the tubular body, the dust drops through the lower opening of the tubular body but does not accumulate.

According to the fifth aspect of the present invention, an X-ray generator having the same components as the aforesaid ones is characterized in that the lumen of the tubular body serves as a passage for the cable linking the electric circuit cards mounted with the tubular body between them.

In the X-ray generator in which the fifth aspect is implemented, the cable linking the electric circuit cards passes through the lumen of the tubular body. This obviates the routing of the cable outside the tank. Consequently, the cable can be routed so that it will not be an obstacle.

According to the sixth aspect of the present invention, an X-ray generator having the same components as the aforesaid ones is characterized in that the electric circuit boards are mounted on an X-ray shooting window side of the tank and on an opposite side thereof. The lumen of the tubular body serves as a passage for the cable linking the electric circuit cards mounted with the tank between them.

In the X-ray generator in which the sixth aspect is implemented, the cable linking the electric circuit cards mounted with the tank between them passes through the lumen of the tubular body. This obviates the routing of the cable outside the tank. Consequently, the cable linking the electric circuit cards mounted with the tank between them can be routed so that it will not be an obstacle.

According to the seventh aspect of the present invention, an X-ray generator having the same components as the aforesaid ones is characterized in that the tubular body has a lip at both ends thereof. When the lips are pressed with attachment plates, the tubular body is locked in the tank and the tank is sealed.

According to the eighth aspect of the present invention, an X-ray generator having the same components as the aforesaid ones is characterized in that the sectional outline of the tubular body is oblong.

In the X-ray generator in which the eighth aspect is implemented, since the sectional outline of the tubular body is oblong, the tubular body can be readily locked in the tank so that the tank will be kept airtight. Moreover, the tubular body readily expands or contracts responsively to a difference in pressure. Moreover, the cable can be readily passed through the lumen of the tubular body.

According to the X-ray generator in which the present invention is implemented, the volume expansion of the insulating fluid derived from heat dissipation caused by the high-voltage assembly and X-ray tube assembly can be compensated for with the expansion or contraction of the tubular body. Moreover, since dust hardly accumulates in the lumen of the tubular body, labor-intensive maintenance is unnecessary. Furthermore, since the cable can be passed through the lumen of the tubular body, the cable will not be routed outside the tank. Consequently, the cable will not be an obstacle, and the neat appearance improves.

Further objects and advantages of the present invention will be apparent from the following description of the preferred embodiments of the invention as illustrated in the accompanying drawings.

BRIEF DESCRIPTION OF THE DRAWINGS

FIG. 10 is a table listing the properties of a material made into the tubular body included in the first embodiment.

DETAILED DESCRIPTION OF THE INVENTION

The present invention will be further described by taking an illustrated embodiment for instance.

Figure 1:
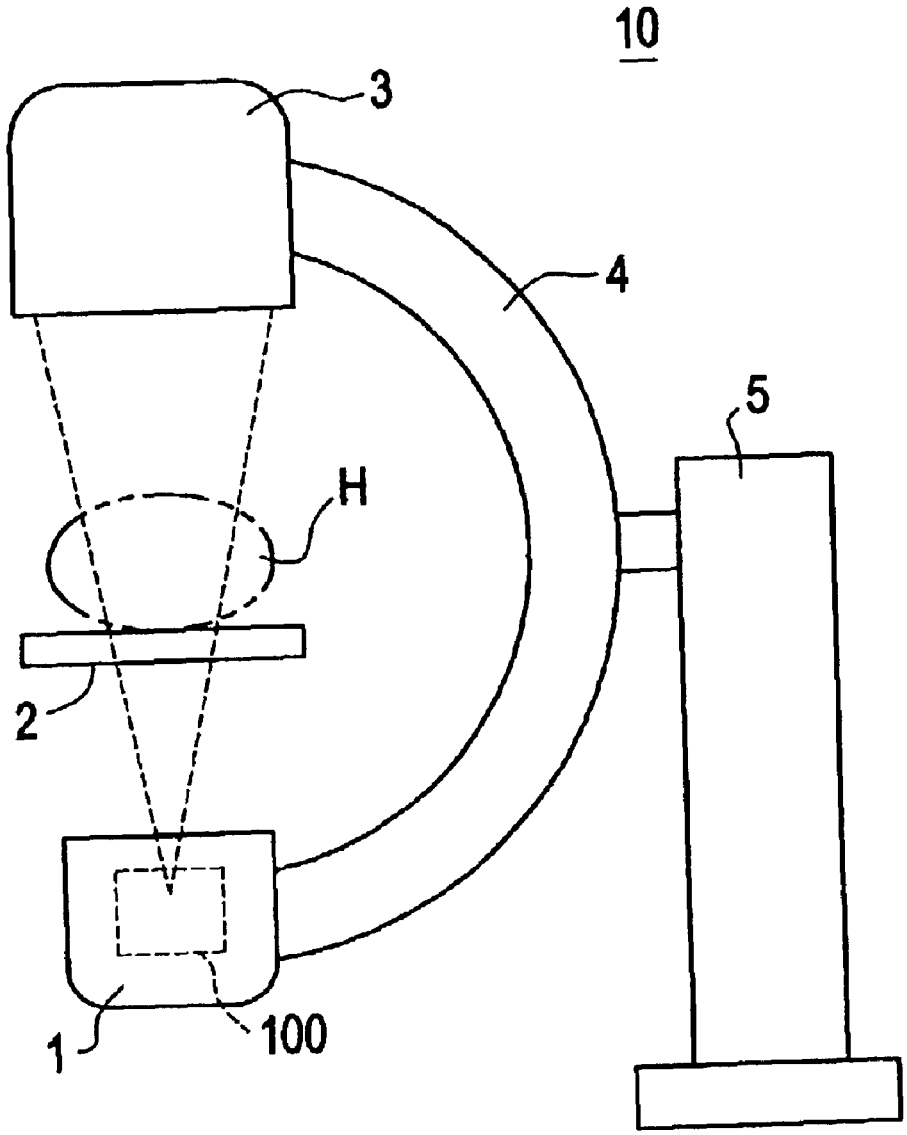
FIG. 1 shows the configuration of an X-ray fluoroscopy system including an X-ray generator in accordance with a first embodiment of the present invention.

FIG. 1 shows the configuration of an X-ray fluoroscopy system 10 including an X-ray generator 100 in accordance with an embodiment of the present invention.

The X-ray fluoroscopy system 10 consists mainly of an irradiator 1 including the X-ray generator 100, a cradle 2 on which a subject H lies down, a detector 3 that detects X-rays transmitted by the subject H, a movable C-arm 4 having the irradiator 1 and detector 3 mounted on the ends thereof, and a stand 5 bearing the movable arm 4.

Figure 2:
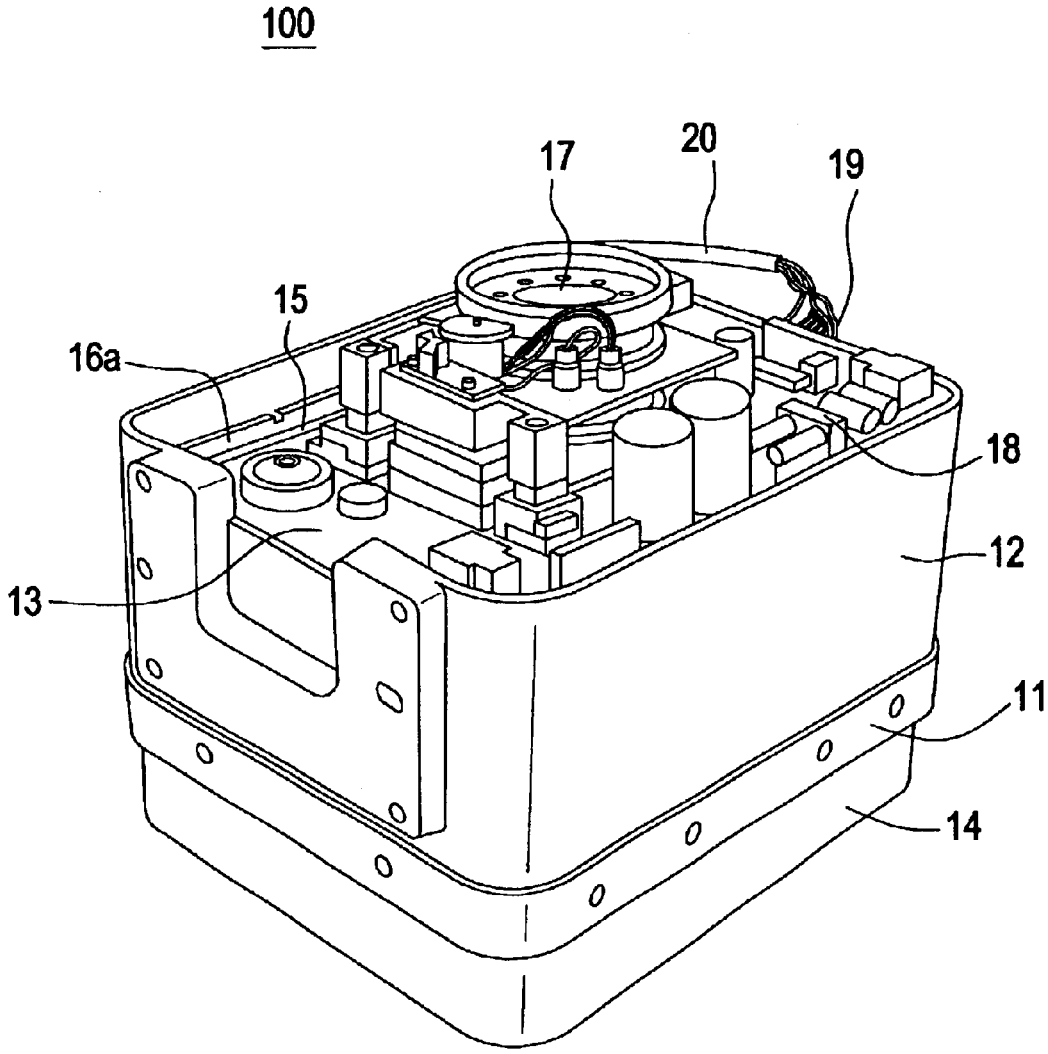
FIG. 2 is a perspective view showing the appearance of the X-ray generator in accordance with the first embodiment.

FIG. 2 is a perspective view showing the appearance of the X-ray generator 100 in accordance with the embodiment of the present invention.

In the X-ray generator 100, a tank base 11, a tank side 12, and a tank top 13 constitute a tank that accommodates a high-voltage assembly (23 in FIG. 8) and an X-ray tube assembly (24 in FIG. 8) and that has an insulating oil (30 in FIG. 8) poured thereinto.

Figure 8:
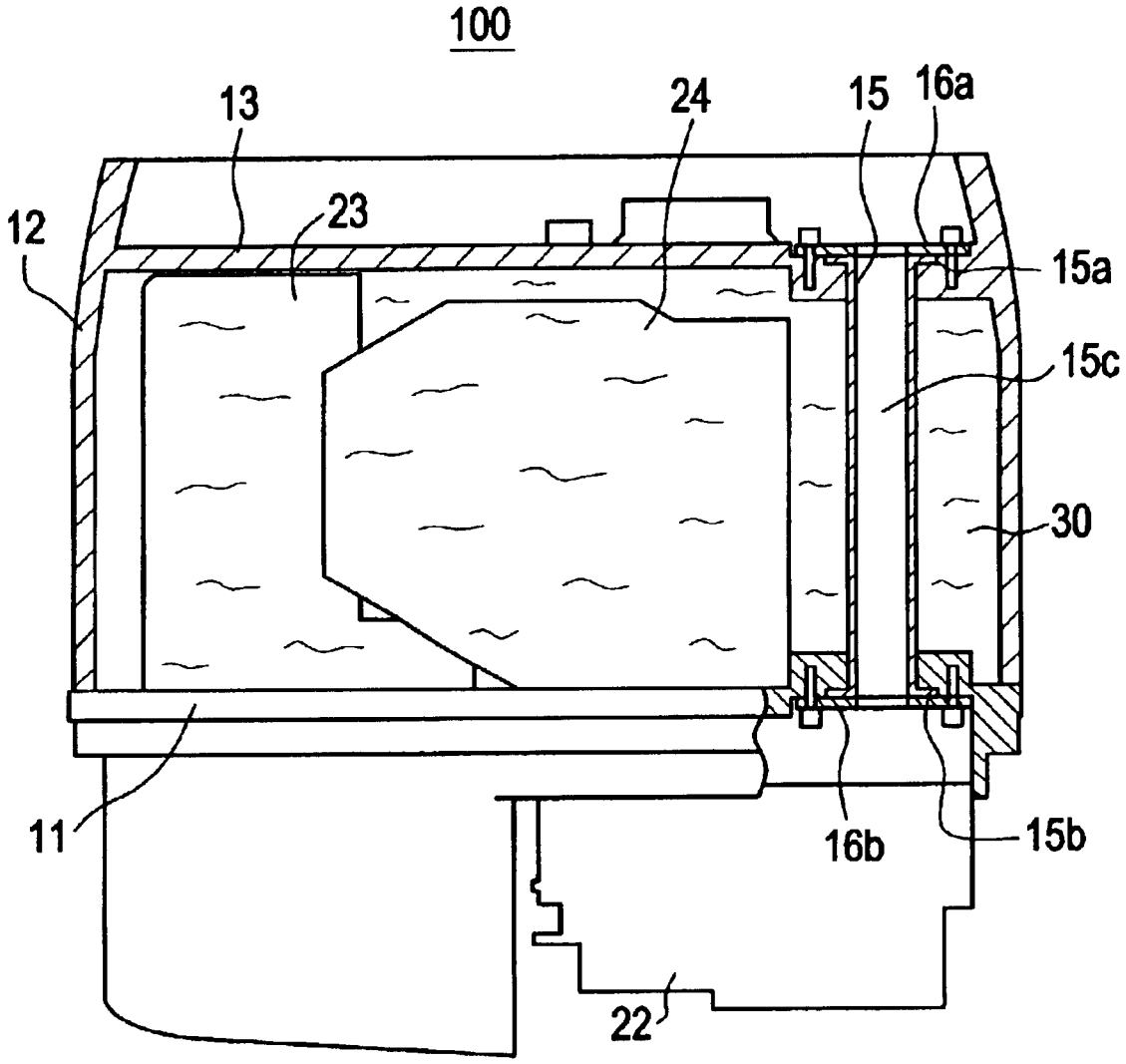
FIG. 8 is a cutaway sectional view showing the major portion of the X-ray generator in accordance with the first embodiment.

The bottom of the tank base 11 is covered with a bottom cover 14 that protects a bottom-side electric circuit card (22 in FIG. 8).

The lumen (15*c* in FIG. 8) of a tubular body 15 made of a rubber material has an opening in the top of the tank top 13. The tubular body 15 has a lip thereof (15*a* in FIG. 8) pressed with an attachment plate 16*a* and is thus fixed to the tank top 13 so that the tank will be kept airtight.

Moreover, an X-ray shooting port 17 has an opening in the top of the tank top 13.

Moreover, an X-ray shooting window-side electric circuit card 18 is mounted on the top of the tank top 13. A cable 20 coupled to a connector 19 of the X-ray shooting window-side electric circuit card 18 is routed to the bottom-side electric circuit card (22 in FIG. 8) through the lumen (15*c* in FIG. 8) of the tubular body 15.

Figure 3:
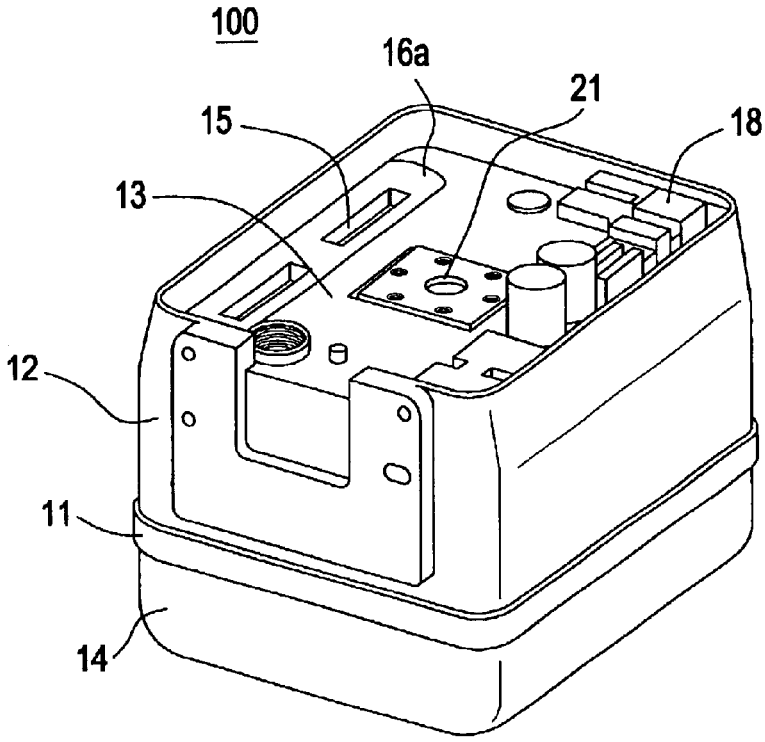
FIG. 3 is a perspective view graphically showing the appearance of the major portion of the X-ray generator in accordance with the first embodiment.

FIG. 3 is a perspective view graphically showing the appearance of a major portion of the X-ray generator 100.

An X-ray shooting window 21 has an opening in the top of the tank top 13.

Figure 4:
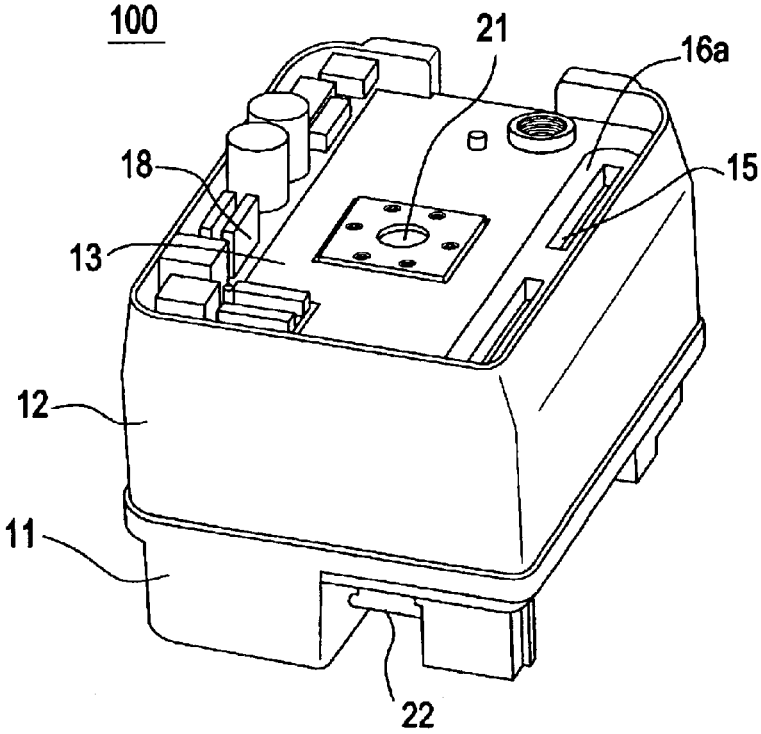
FIG. 4 is a perspective top view graphically showing the appearance of the major portion of the X-ray generator in accordance with the first embodiment with a bottom cover thereof removed.
Figure 5:
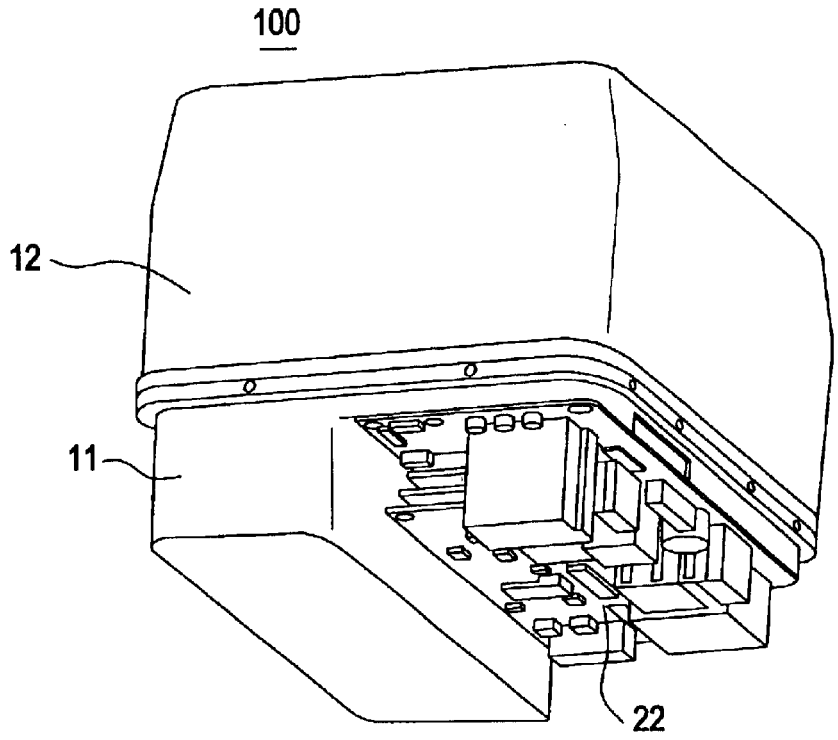
FIG. 5 is a perspective bottom view graphically showing the appearance of the major portion of the X-ray generator in accordance with the first embodiment with the bottom cover thereof removed.

FIG. 4 and FIG. 5 are perspective views graphically showing the appearance of the major portion of the X-ray generator 10 with the bottom cover 14 removed.

When the bottom cover 14 is removed, the bottom-side electric circuit card 22 becomes visible.

Figure 6:
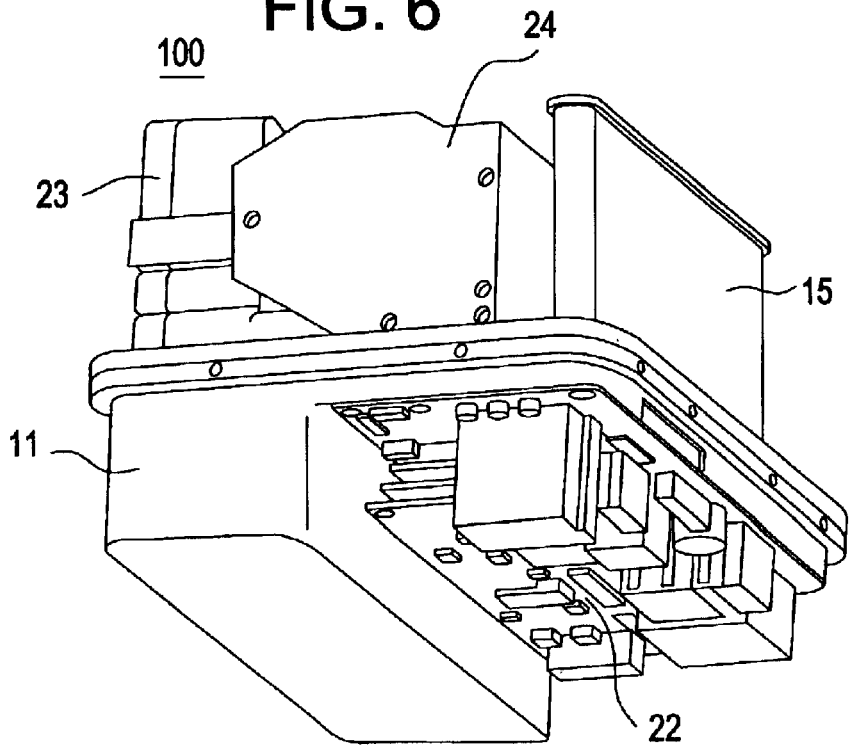
FIG. 6 is a perspective bottom view graphically showing the appearance of the major portion of the X-ray generator in accordance with the first embodiment with a tank side and tank top thereof removed.
Figure 7:
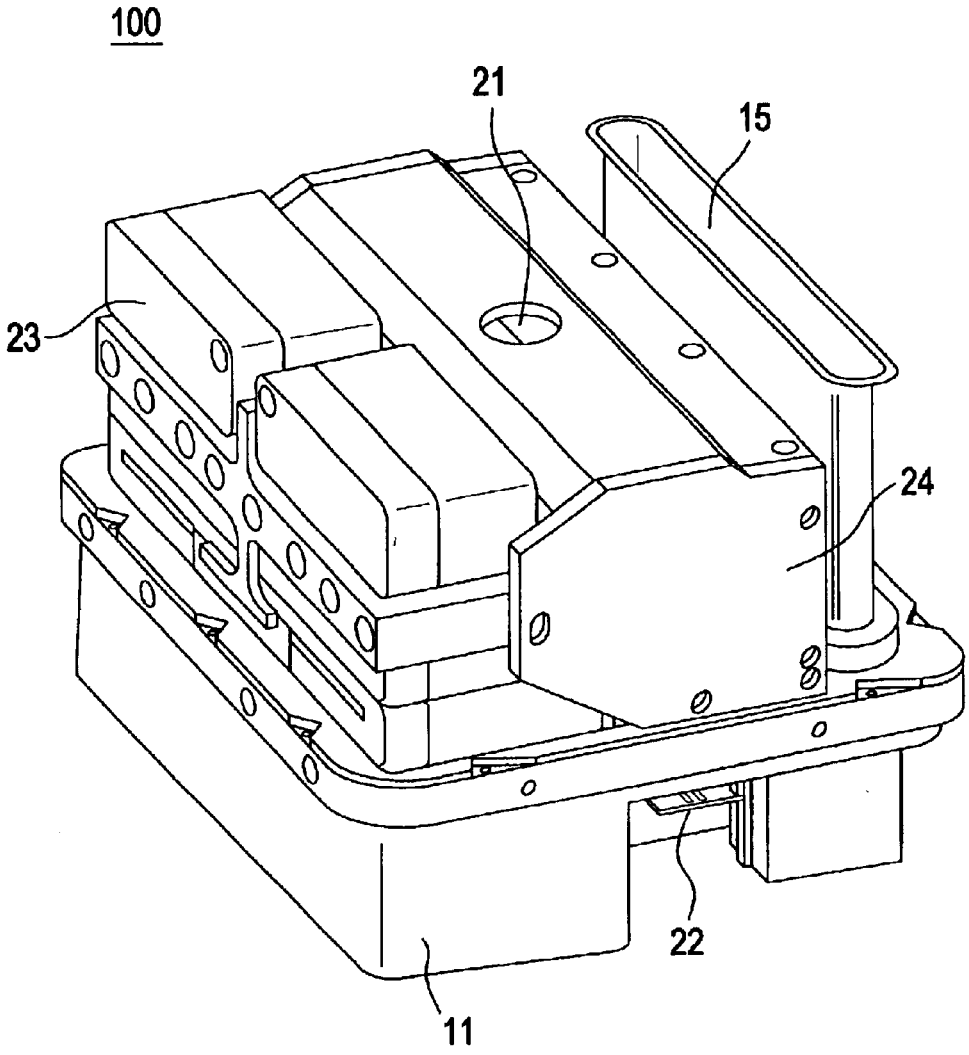
FIG. 7 is a perspective top view graphically showing the appearance of the major portion of the X-ray generator in accordance with the first embodiment with the tank side and tank top thereof removed.

FIG. 6 and FIG. 7 are perspective views graphically showing the appearance of the major portion of the X-ray generator 10 with the tank side 12 and tank top 13 removed.

When the tank side 12 and tank top 13 are removed, the tubular body 15, high-voltage assembly 23, and X-ray tube assembly 24 become visible.

FIG. 8 is a cutaway sectional view showing the major portion of the X-ray generator 100.

The tubular body 15 penetrates through the tank which accommodates the high-voltage assembly 23 and X-ray tube assembly 24 and which has the insulating oil 30 poured thereinto. The tubular body 15 has an opening in both the top of the tank top 13 and the bottom of the tank base 11 respectively.

The tubular body 15 has the lip 15*a* thereof pressed with the attachment plate 16*a*, and is thus fixed to the tank top 13 so that the tank will be kept airtight. Moreover, the tubular body 15 has the lip 15*b* thereof pressed with the attachment plate 16*b*, and is thus fixed to the tank base 11 so that the tank will be kept airtight.

The tank side 12 and tank top 13 are molded into a united body.

Figure 9A:
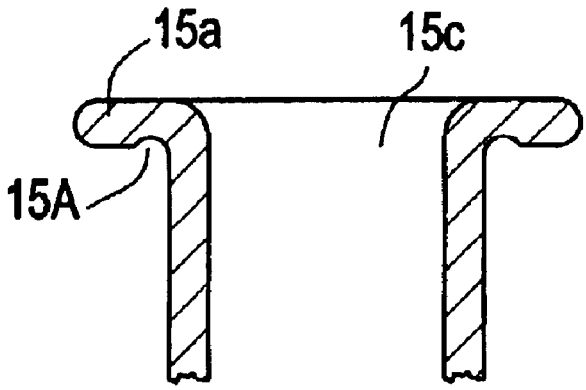
FIG. 9 includes an enlarged sectional view showing a lip of a tubular body included in the first embodiment and a cross-sectional view showing the sectional outline thereof.
Figure 9B:
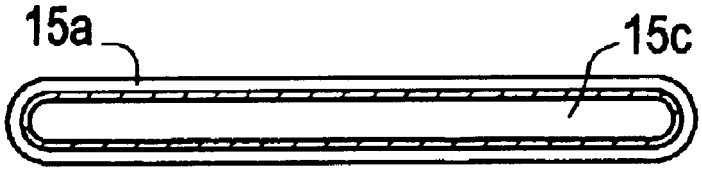

FIG. 9(*a*) is an enlarged sectional view showing the lip 15*a* of the tubular body 15.

The lip 15*a* has a dent 15A formed in order to facilitate deformation of the lip 15*a*. The lip 15*b* also has a dent, though the dent is not shown.

FIG. 9(*b*) is a sectional view showing the section of the tubular body 15 seen from below.

The sectional outline of the tubular body 15 is oblong.

FIG. 10 is a table listing the properties of a material made into the tubular body 15.

The material of the tubular body 15 is butadiene and acrylic nitride (NBR) grade rubber of up to Shore hardness 75. The operational temperature ranges from −30° C. to 120° C. However, the normal use temperature ranges from 20° C. to 70° C.

Next, referring to FIG. 11 to FIG. 14, a procedure of assembling the components of the X-ray generator 100 will be described below.

Figure 11:
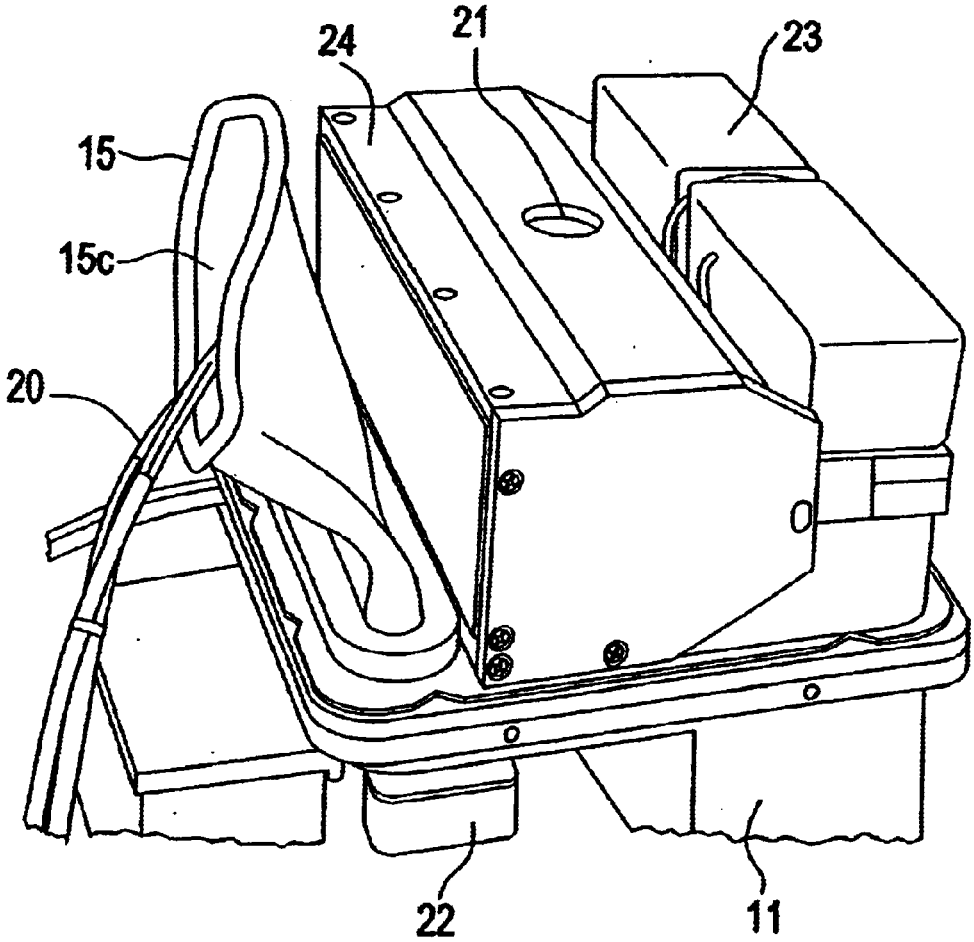
FIG. 11 is a first perspective view showing a procedure of assembling the components of the X-ray generator in accordance with the first embodiment.

First, as shown in FIG. 11, the tubular body 15, high-voltage assembly 23, X-ray tube assembly 24, and bottom-side electric circuit card 22 are mounted on the tank base 11. The cable 20 extending from the bottom-side electric circuit card 22 passes through the lumen 15*c* of the tubular body 15.

Figure 12:
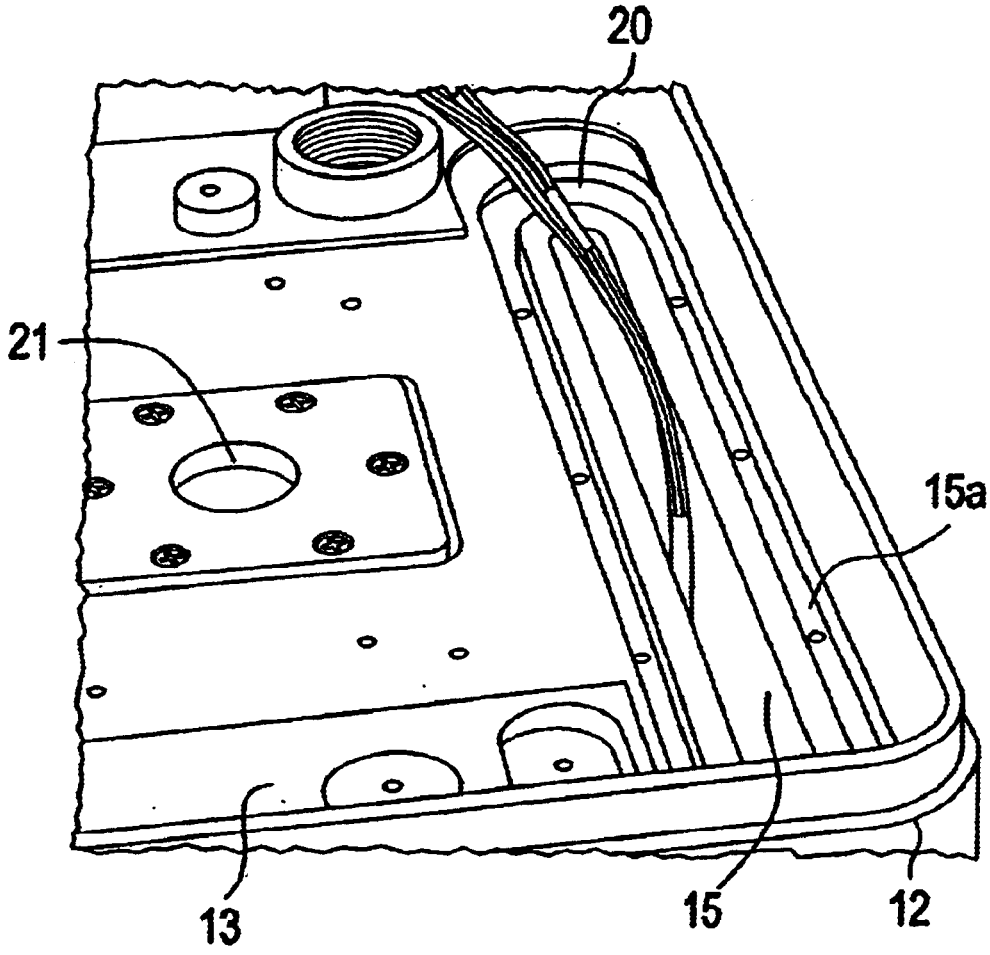
FIG. 12 is a second perspective view showing the procedure of assembling the components of the X-ray generator in accordance with the first embodiment.

Thereafter, as shown in FIG. 12, the tank side 12 and tank top 13 are fixed to the tank base 11 so that the tank will be kept airtight. The lip 15*a* of the tubular body 15 is exposed on the top of the tank top 13.

Figure 13:
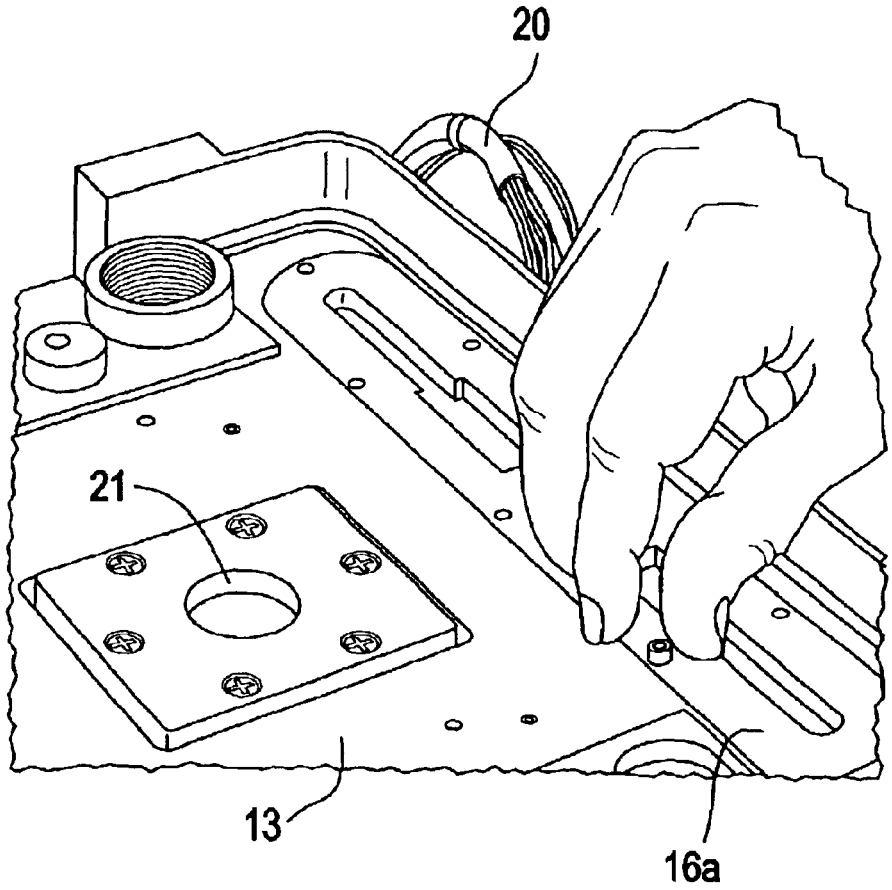
FIG. 13 is a third perspective view showing the procedure of assembling the components of the X-ray generator in accordance with the first embodiment.

Thereafter, as shown in FIG. 13, the attachment plate 16*a* is fixed to the tank top. At this time, the lip 15*a* of the tubular body 15 is pressed to the top of the tank top 13 with the attachment plate 16*a* so that the tank will be kept airtight.

Figure 14:
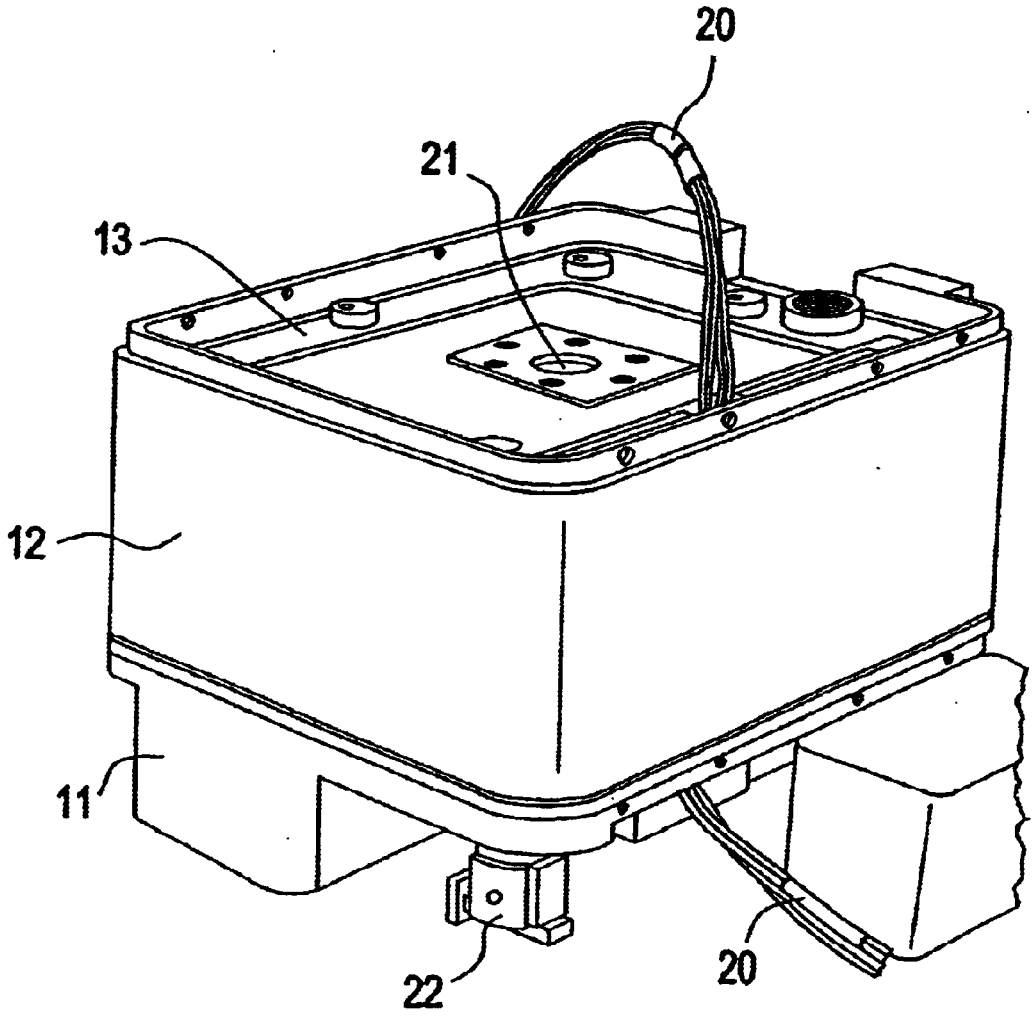
FIG. 14 is a fourth perspective view showing the procedure of assembling the components of the X-ray generator in accordance with the first embodiment.

This results in an assembly shown in FIG. 14.

Thereafter, the insulating oil 30 is poured into the tank. The insulating oil 30 is poured at 65° C. in a vacuum, and the tank is sealed under an atmospheric pressure. At this time, the tank must be sealed with caution for fear bubbles may be mixed in the insulating oil 30.

Finally, as shown in FIG. 2, the X-ray shooting window-side electric circuit card 18 and others are mounted on the top of the tank top 13. Moreover, the cable 20 is spliced to the connector of the X-ray shooting window-side electric circuit card 18.

The foregoing X-ray generator 100 provides the advantages described below.

(1) The tubular body 15 expands or contracts depending on a difference between the pressure in the lumen 15*c* of the tubular body 15 and the internal pressure of the tank. Since the lumen 15*c* opens onto the ambient space, the internal pressure of the tank remains substantially equal to the pressure in the ambient space. In short, the volume expansion of the insulating oil 30 derived from heat dissipation caused by the high-voltage assembly 23 and X-ray tube assembly 24 can be compensated for.

(2) The lumen 15*c* of the tubular body 15 opens onto the ambient space on the bottom of the tank base 11 and on the top of the tank top 13 respectively. Dust floating in the ambient space hardly accumulates in the lumen 15*c*. This obviates the necessity of labor-intensive maintenance.

(3) Since the tubular body 15 penetrates through the tank, when the cable 20 linking the electric circuit cards 18 and 22 mounted with the tank between them passes through the lumen 15*c*, the necessity of routing the cable outside the tank is obviated. Consequently, the cable linking the electric circuit cards mounted with the tank between them will not be an obstacle. Furthermore, the neat appearance of the X-ray generator improves.

(4) The tubular body 15 has a structure permitting ready manufacture. Moreover, since the sectional outline of the tubular body is oblong, the tubular body can be locked in the tank so that the tank will be kept airtight. Moreover, the tubular body expands or contracts highly sensitively to a difference in pressure. The cable can be easily passed through the lumen 15*c*.

According to other embodiment, the tubular body 15 is made of such a material as a chloroprene rubber (CR), an acrylic rubber (ACM), a fluorocarbon rubber (FKM), a hydrin rubber (ECO, CO), an ethylene-vinyl acetate copolymer rubber, an ethylene-vinyl acetate-acrylate copolymer rubber, an ethylene-acrylate copolymer rubber, or a phosphazene rubber.

Moreover, the sectional outline of the tubular body 15 may be circular.

Many widely different embodiments of the invention may be configured without departing from the spirit and the scope of the present invention. It should be understood that the present invention is not limited to the specific embodiments described in the specification, except as defined in the appended claims.

What is claimed is:

1. An X-ray generator having a tank, which accommodates a high-voltage assembly and an X-ray tube assembly, has an insulating fluid poured thereinto, and is sealed, comprising:

a tubular body penetrating through said tank, wherein: the lumen of said tubular body opens onto the ambient space at both ends of said tubular body; and said tubular body expands or contracts depending on a difference between the luminal pressure thereof and the internal pressure of the tank.

2. The X-ray generator according to claim 1, wherein said tubular body is made of an oil-proof rubber material.

3. The X-ray generator according to claim 2, wherein said oil-proof rubber material is a nitrile rubber.

4. The X-ray generator according to claim 1, wherein said tubular body penetrates through said tank in a direction of X-irradiation.

5. The X-ray generator according to claim 1, wherein the lumen of said tubular body serves as a passage for a cable.

6. The X-ray generator according to claim 4, wherein: an electric circuit card is mounted on an X-ray shooting window side of said tank and on an opposite side thereof respectively; and the lumen of said tubular body serves as a passage for the cable linking the electric circuit cards mounted with said tank between them.

7. The X-ray generator according to claim 1, wherein: said tubular body has a lip at both ends thereof; and when the lips are pressed with attachment plates, said tubular body is locked in said tank and said tank is sealed.

8. The X-ray generator according to claim 1, wherein the sectional outline of said tubular body is oblong.

* * * * *